United States Patent [19]

Sechrist

[11] 4,257,332

[45] Mar. 24, 1981

[54] RAILWAY TANK CAR CRADLE SUPPORT

[75] Inventor: Mark A. Sechrist, Northumberland, Pa.

[73] Assignee: ACF Industries, Incorporated, New York, N.Y.

[21] Appl. No.: 48,925

[22] Filed: Jun. 15, 1979

[51] Int. Cl.[3] ..... B61D 5/06; B61F 1/00; B61F 1/14

[52] U.S. Cl. ..... 105/362; 105/226; 105/228

[58] Field of Search ..... 105/358, 360, 362, 226, 105/228

[56] References Cited

U.S. PATENT DOCUMENTS

| | | | |
|---|---|---|---|
| 3,308,769 | 3/1967 | Halcomb et al. | 105/362 |
| 3,467,027 | 9/1969 | Brown | 105/362 |
| 3,557,708 | 1/1971 | Bolte | 105/362 X |
| 3,626,867 | 12/1971 | Becker | 105/362 |

*Primary Examiner*—Howard Beltran
*Attorney, Agent, or Firm*—Henry W. Cummings

[57] ABSTRACT

A tank car stub sill underframe is assembled by welding together a pair of angles to opposite edges of a longitudinally extending curved plate to form a generally channel-shaped section. The channel-shaped section includes a concave top plate and a pair of vertically extending legs welded to the concave top plate. Each leg includes an outwardly extending, horizontal flange at the base of each leg. The curved plate includes a first portion extending from the end of the car inboard to a point adjacent, but outboard of, the car body bolster in which the curved plate spans the distance between the vertical legs and each of the plate's transverse outer edges engage the upper end of one of the vertical legs. The curved portion includes a second or intermediate portion extending from the inner end of the first portion through the body bolster area and continuing considerably inboard of the bolster area. In this second, or intermediate, portion the transverse outer edges of the curved plate extend outwardly and above the vertical legs in a concave contour to support the tank. A conventional body bolster extends transversely on either side of the stub sill. The bolster includes a top cover plate which abuts and is welded to the respective outer edges of the curved plate. A third, inner portion of the curved plate extends inboard of the intermediate portion to reinforce the tank. The transverse extent of the curved plate preferably is gradually reduced on each side of the third or inner portion, forming a pair of transversely spaced, horizontal tapers.

5 Claims, 5 Drawing Figures

RAILWAY TANK CAR CRADLE SUPPORT

BACKGROUND OF THE INVENTION

This invention relates to stub sill underframes for railway tank cars.

Previously, stub sill underframes for railway tank cars have been fabricated by welding together a pair of Z sections to form a channel and then burning out an opening to receive a curved tank car cradle pad to reinforce the tank. In addition, in the burned out area, reinforcing gussets extending vertically between the stub sill flanges and the top of the stub sill are provided.

Welding the Z sections together, burning out the opening and welding in place the horizontal reinforcements are timeconsuming and expensive operations.

In another construction disclosed in U.S. Pat. No. 3,308,769, the horizontal portion of the channel is formed into a concave shape and a cradle pad is welded to the upper surface of this concave surface.

SUMMARY OF THE INVENTION

The object of the present invention is to provide a simpler and less expensive tank car stub sill.

In accordance with the present invention, a tank car stub sill underframe is assembled by welding together a pair of angles to opposite edges of a longitudinally extending curved plate to form a generally channel-shaped section. The channel-shaped section includes a concave top plate and a pair of vertically extending legs welded to the concave top plate. Each leg includes an outwardly extending, horizontal flange at the base of the leg. The curved plate may be formed as a single piece or as a series of separate pieces. The curved plate includes a first portion extending from the end of the car inboard to a point adjacent, but outboard of, the car body bolster in which the curved plate spans the distance between the vertical legs and each of the plate's transverse outer edges engage the upper end of one of the vertical legs. The curved plate includes a second or intermediate portion extending from the inner end of the first portion through the body bolster area and continuing considerably inboard of the bolster area. In this second or intermediate portion the transverse outer edges of the curved plate extend outwardly and above the vertical legs in a concave contour to reinforce the tank. A conventional coupler and draft gear are located in the outer end portion of the stub sill. A conventional center filler is located in the stub sill between the vertical legs. A conventional body bolster extends transversely on either side of the center filler. The body bolster includes a top cover plate which abuts and is welded to the respective outer edges of the curved plate. Inboard of the bolster, the horizontal flanges are eliminated from the vertical legs and the vertical legs are gradually vertically foreshortened to form a tapered end portion. A horizontal reinforcing plate is optionally welded to the bottom of the curved plate adjacent the tapered end portion. The intermediate portion of the curved plate preferably extends beyond the end of the vertical legs. A third inner portion of the curved plate extends inboard of the intermediate portion to reinforce the tank. The transverse extent of the curved plate preferably is gradually reduced on each side of the third or inner portion, forming a pair of transversely spaced, horizontal tapers.

THE DRAWINGS

DESCRIPTION OF PREFERRED EMBODIMENTS

Figure 1:
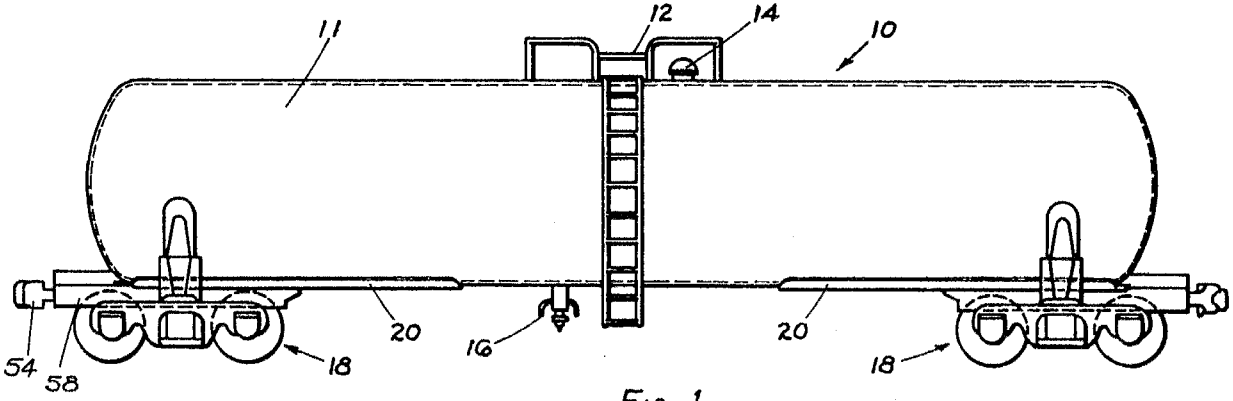
FIG. 1 is a side elevation view of a railway tank car constructed according to the present invention.
Figure 2:
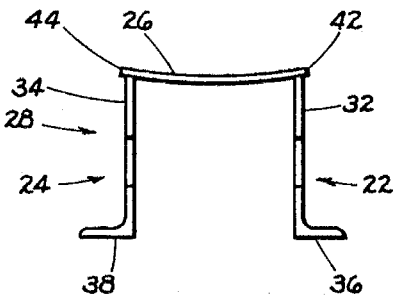
FIG. 2 is an end view with the coupler and draft gear removed illustrating the stub sill underframe of the present invention.

A railway tank car 10 includes a tank 11, a dome 12, a safety valve 14 and a lading valve 16. The lading may be loaded through the dome 12 or through the lading valve 16, as is known in the art. The car is supported at opposite ends by trucks 18.

The present invention is concerned with the stub sill structure 20, one of which is located at each end of the car. Since the construction of each underframe structure 20 is the same only one end will be described.

In accordance with the present invention, the tank car stub sill underframe 20 is assembled by welding together a pair of angles 22 and 24 to opposite sides of a longitudinally extending curved plate 26 to form a generally channel-shaped section 28. The channel-shaped section includes a concave top plate 30 and a pair of vertically extending legs 32 and 34 welded to the concave top plate. Each leg includes an outwardly extending, horizontal flange indicated at 36 and 38 at the base of each leg.

The curved plate 26 may be formed as a single piece or as a series of separate pieces. The curved plate includes a first portion 40 extending from the end of the car inboard to a line 41 adjacent, but outboard of, the car body bolster 43. In this position, curved plate 40 spans the distance between the vertical legs 32 and 34 and each of the plate's transverse outer edges 42 and 44 engage the upper end of one of the vertical legs.

The curved plate includes a second or intermediate portion 50 extending from the inner end of the first portion through the body bolster area 43 and continuing considerably inboard of the bolster area. In this second or intermediate portion, the transverse outlet edges 52 and 54 of the curved plate extend outwardly and above the vertical legs in a concave contour and reinforce the tank 11.

A conventional coupler 54 and draft gear 58 are located in the stub sill below outer end portion 40. Plates 59, held in place with fasteners 59a hold the draft gear and coupler in place. A conventional center filler 60, including a striker assembly, is located in the stub sill between the legs 32 and 34 in the intermediate portion. Openings 62 are provided in the legs 32 and 34 to weld the center filler 60. The center filler 60 is also welded to legs 32 and 34 at the bottom 61, forming a solid unit.

Figure 5:
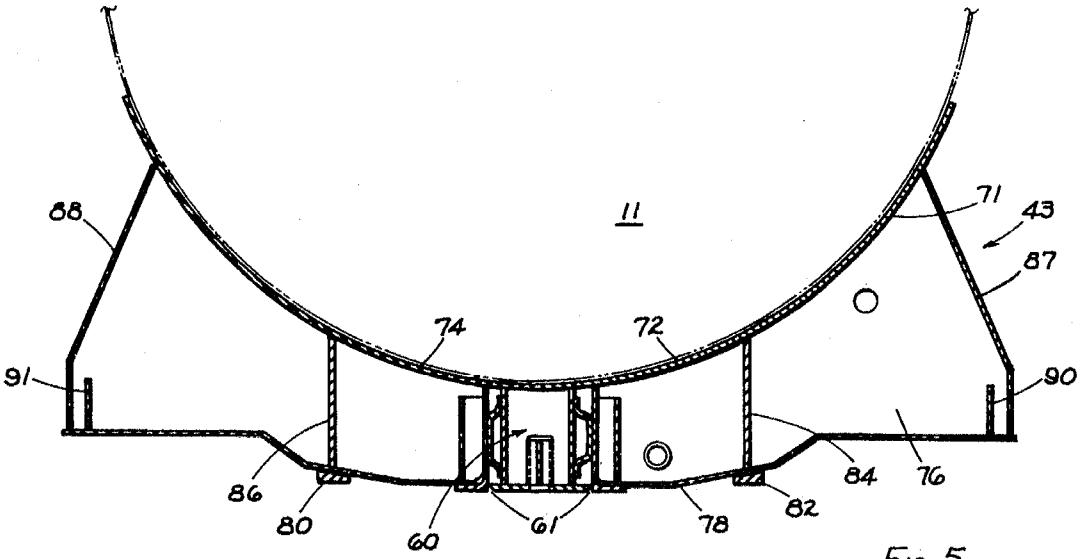
FIG. 5 is a sectional view looking in the direction of the arrows along the line 5—5 in FIG. 4.
Figure 4:
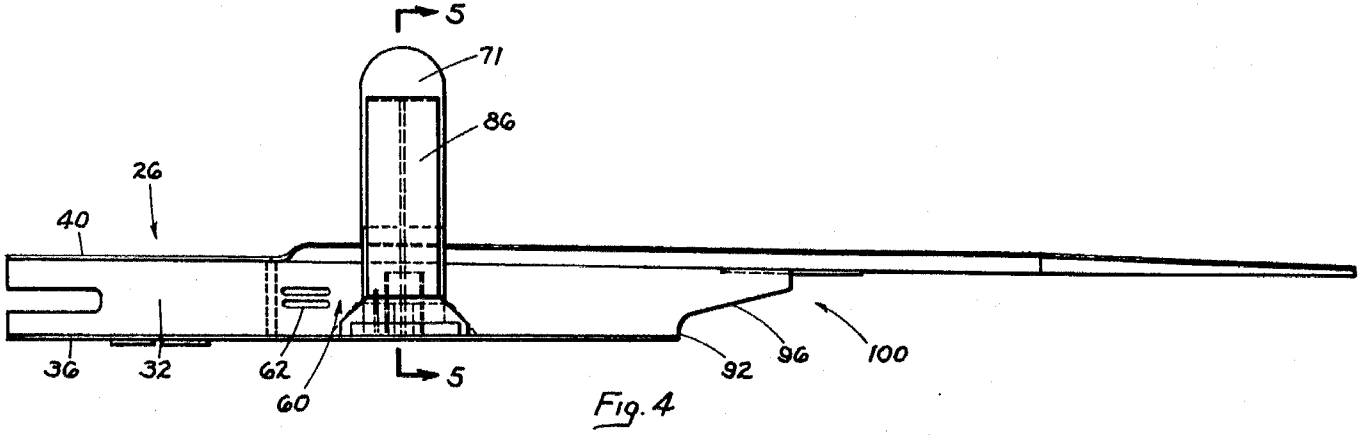
FIG. 4 is a side elevation view of the stub sill underframe of the present invention.
Figure 3:
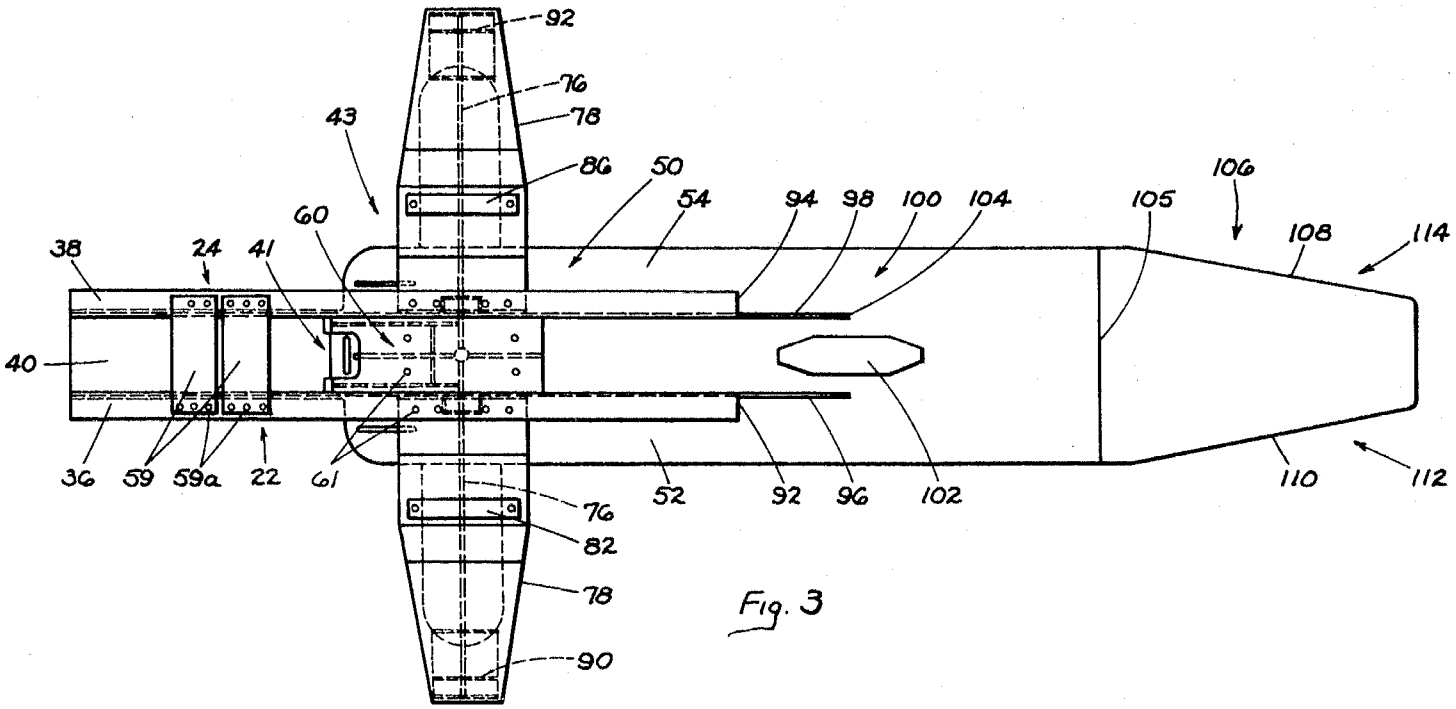
FIG. 3 is a bottom view of the stub sill underframe of the present invention.

The body bolster 43 is conventional and extends transversely on either side of the stub sill. The bolster includes (FIG. 5) top cover plate 71 which abuts and is welded to the respective outer edges 72 and 74 of the curved plate. The body bolster further includes a vertical web 76, a lower cover plate 78, having attached thereto side bearings 80 and 82. Side bearing supports 84 and 86 extend vertically above side bearings 80 and 82 and are welded to vertical web 76, and to cover plate 71 and bottom cover plate 78. Bolster cap plates 87 and 88 extend vertically upwardly from bottom cover plate 78 and inwardly, and engage top cover plate 71. Vertical gussets 90 and 91 also reinforce the bottom cover plate 78 at the sides.

Inboard of the bolster 43, the horizontal flanges 36 and 38 are eliminated from the vertical legs at 92 and 94. Also, the vertical legs 32 and 34 are gradually vertically foreshortened at 96 and 98 to form a tapered end portion 100. A horizontal reinforcing plate 102 is optionally welded to the bottom of the plate portion 50 adjacent the tapered end portion. The intermediate portion 50 of the curved plate preferably extends beyond the end of the vertical legs 96 and 98 and terminates at 104.

A third inner curved plate portion 106 extends inboard of the intermediate portion to reinforce the tank 11. The transverse extent of the curved plate preferably is gradually reduced on each side of the third or inner portion at 108 and 110, forming a pair of transversely spaced tapers 112 and 114.

In the arrangement shown, the curved plate 26 is formed in three portions 40, 50 and 106 which are welded into a unitary piece along transverse weld lines 41 and 105. If desired, either portions 40 and 50 may be made of a single piece of material, or portions 50 and 106 made of a single piece of material, or portions 40, 50 and 106 may be made of a single piece of material.

The tank 11 is welded to the portions 50 and 106 along the edges 52, 54 and 108, 110 to provide integral reinforcement for the tank 11. After welding, the assembly is stress relieved.

It will be apparent that the need for welding a pair of Z sections together to form a stub sill, and then burning out a portion to receive the cradle pad, is eliminated with the present invention. Furthermore, the reinforcements previously required adjacent the cut-out are no longer required. Thus, a simpler and less expensive stub sill underframe is provided with the present invention.

What is claimed is:

1. A tank car stub sill underframe comprising: a pair of angles welded to opposite sides of a longitudinally extending curved plate to form a generally channel-shaped section; including a concave top plate and a pair of vertically downwardly extending legs from said top plate; each leg including an outwardly extending horizontal flange at its base; said curved plate including an outer end portion positioned at an end of the car and extending inboard to a point adjacent a car body bolster in which the curved plate spans the distance between the vertical legs and each of the curved plate's transverse outer edges engage an upper end of one of said vertical legs; said curved plate including an intermediate portion extending from an outer side of said body bolster through said body bolster and extending to an inner side of said body bolster; in said intermediate portion transverse outer edges of the curved plate extending outwardly and above the vertical legs in a concave contour to reinforce the tank; a body bolster extending transversely on each transverse side of said intermediate portion; said body bolster including a curved top cover plate which abuts and is welded to the respective outer edges of said curved plate; an inner portion of the curved plate extending from the inner side of said intermediate portion to reinforce the tank; on each transverse side of the inner portion, the transverse extent of the curved plate being gradually reduced, forming a pair of transversely spaced, generally horizontal tapers; said curved plate being welded to the tank in said intermediate and inner portions.

2. A tank car stub sill underframe according to claim 1 wherein, in said intermediate portion inboard of the bolster, said horizontal flanges are eliminated from said vertical legs.

3. A tank car stub sill underframe according to claim 2 wherein said vertical legs are gradually vertically foreshortened to form a tapered portion outboard of said horizontal flanges.

4. A tank car stub sill underframe according to claim 3 wherein a horizontal reinforcing plate is welded to the bottom of the curved plate adjacent said tapered portion.

5. A tank car stub sill underframe according to claim 1 wherein the intermediate portion of the curved plate extends beyond the vertical legs.

* * * * *